United States Patent [19]

Won

[11] Patent Number: 4,586,609

[45] Date of Patent: May 6, 1986

[54] TAG PIN FASTENER ASSEMBLY AND METHOD

[75] Inventor: Yong K. Won, Seoul, Rep. of Korea

[73] Assignee: Ben Clements & Sons, Inc., South Hackensack, N.J.

[21] Appl. No.: 692,734

[22] Filed: Jan. 18, 1985

[30] Foreign Application Priority Data

Jan. 21, 1984 [KR] Rep. of Korea ..... 259

[51] Int. Cl.[4] ..... B65D 85/24

[52] U.S. Cl. ..... 206/343; 24/150 FP; 40/20 R; 206/348; 206/380; 206/820; 264/249; 264/250

[58] Field of Search ..... 24/72.7, 150 B, 150 FP, 24/150 R, 298; 40/20 R, 21 R, 24; 206/343, 346, 348, 380, 820; 264/291, 249, 250

[56] References Cited

U.S. PATENT DOCUMENTS 4,347,932 9/1982 Furutu ..... 24/150 FP

*Primary Examiner*—William Price
*Assistant Examiner*—Jimmy G. Foster
*Attorney, Agent, or Firm*—Blum Kaplan Friedman Silberman & Beran

[57] ABSTRACT

A tag pin fastener assembly includes a first tag pin assembly member having a first connecting rod and a plurality of tag pins coupled to the first connecting rod in a predetermined spacing, and a second tag pin assembly member having a second connecting rod and a plurality of tag pins coupled to the second connecting rod in the same predetermined spacing. The two connecting rods are coupled together so that the tag pins on the first rod are alternately arranged with the tag pins on the second rod.

19 Claims, 9 Drawing Figures

FIG. 6
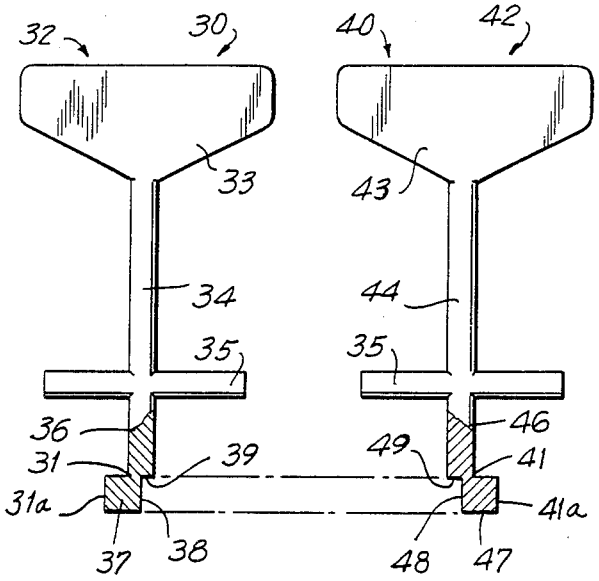
FIG. 7
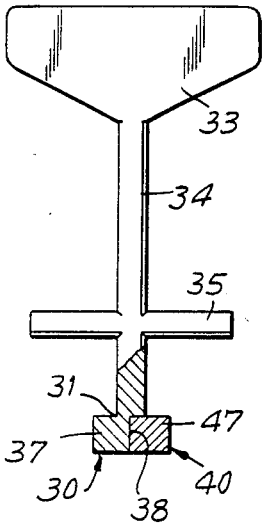
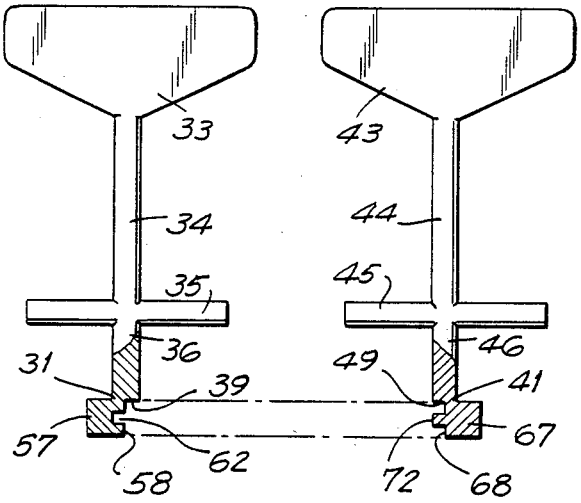
FIG. 8
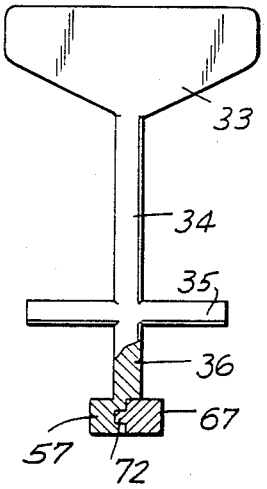
FIG. 9

TAG PIN FASTENER ASSEMBLY AND METHOD

BACKGROUND OF THE INVENTION

The present invention is generally directed to a fastener assembly and method of manufacturing a fastener assembly and, in particular, to an improved tag pin fastener assembly in which individual tag pins are used for attaching tags to merchandise, and to a method of constructing such a tag pin fastener assembly.

Conventional tag pin fasteners used in attaching tags to clothing and other merchandise generally include a head section and a lateral rod section or cross-bar which are coupled together by a string or filament. The tag pin assembly is integrally molded from a plastic material. Individual tag pins are intergrally formed on a connecting rod by means of connecting necks which extend from the cross-bars. The assembly is loaded into a tag attaching gun which removes and feeds individual fasteners from the assembly such that the cross-bar penetrates the clothing or merchandise involved and becomes engaged therewith. For convenience in use, the fasteners are made in the form of an assembly which generally includes about 50 individual fasteners on the connecting rod.

Attempts have been made for increasing the number of fasteners per unit length in a fastener assembly so that the fastener assembly can be made smaller and the time for loading a new fastener assembly into the attaching gun can be reduced. This, in turn, would allow the use of more fasteners during a specified time period and consequently more clothing and other merchandise can be tagged without reloading the attaching gun.

One method for increasing the fasteners per unit length is by using a mold with thin mold walls whereby the thickness of a fastener is reduced and the distance between each fastener on the assembly is also reduced. Tests have been carried out whereabout twice as many tag pins in the same unit length have been molded by molding in a single die such that the thickness of each fastener is reduced to 0.8 to 0.9 mm and the distance between each fastener is about 0.1 to 0.3 mm. Such a method, however, requires special precision in preparing the mold since the thickness of the mold wall between the individual grooves required for making each fastener is a minute distance between about 0.2 to 0.4 mm. Furthermore, a mold having such a small distance between the grooves can be easily damaged, and thus commercial production is practically impossible.

Accordingly, it is desired to provide an improved tag pin fastener assembly and method wherein the number of fasteners per unit length is increased in order to reduce the size of the fastener package and reduce the time for refilling the fastener assembly in a tag attaching gun.

SUMMARY OF THE INVENTION

Generally speaking, in accordance with the present invention, a tag pin fastener assembly wherein tag pins on the assembly are used for attaching tags to merchandise is provided. The tag pin fastener assembly includes a first tag pin assembly member having a first connecting rod and a plurality of tag pins coupled to the first connecting rod in a predetermined spacing. The assembly also includes a second tag pin assembly member having a second connecting rod and a plurality of tag pins coupled to the second connecting rod in the predetermined spacing. Coupling means are provided for coupling the first and second rods together so that the tag pins on the first rod are alternately arranged with the tag pins on the second rod whereby a tag pin fastener assembly is provided.

In a preferred embodiment, the tag pins each include a head section and cross-bar section joined together with a filament or string. A connecting neck extends from the cross-bar in a direction opposite to the filament which couples the tag pins to the connecting rod. The connecting neck is formed partially on the connecting rod such that a portion of the neck extends off of the connecting rod. When the two connecting rod members are coupled, the tag pins on the two connecting rods will be alternately spaced in a straight line. Various methods of coupling the connecting rods are possible such as, for example, by using an adhesive, by melting or heat fusion, by a tongue and groove arrangement, by a snap-type fit, and the like.

Under the method of the present invention, the steps include molding a first tag pin assembly member having a first connecting rod and a plurality of tag pins coupled to the first connecting rod in a predetermined spacing, and molding a second tag pin assembly member having a second connecting rod and a plurality of tag pins coupled to the second connecting rod in the predetermined spacing. A further step includes coupling of the first and second connecting rods such that the tag pins are alternately arranged along the combined connecting rods.

Accordingly, it is an object of the present invention to provide an improved tag pin fastener assembly and method.

It is another object of the present invention to provide an improved tag pin fastener assembly wherein individual tag pins are used for attaching tags to merchandise.

It is a further object of the present invention to provide an improved fastener assembly wherein the spacing between adjacent tag pins is substantially reduced and wherein the number of fasteners per unit length on the assembly is increased.

Still another object of the present invention is to provide an improved fastener assembly which reduces the time for reloading a tag attaching gun.

Still a further object of the present invention is to provide an improved tag pin fastener assembly and method that does not require special precision in preparing a mold for constructing the assembly.

Yet another object of the present invention is to provide an improved fastener assembly which is easy to manufacture.

Still other objects and advantages of the invention will in part be obvious and will in part be apparent from the specification.

The invention accordingly comprises the several steps and the relation of one or more of such steps with respect to each of the others, and the article possessing the features, properties, and the relation of elements, which are exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 is a front elevational view in partial cross-section of the two members of the fastener assembly prior to being coupled;

FIG. 7 is a front elevational view in partial cross-section of the fastener assembly of FIG. 6 shown coupled;

FIG. 8 is a front elevational view in partial cross-section of another embodiment of the fastener assembly in accordance with the present invention shown prior to coupling; and FIG. 9 is a front elevational view in partial cross-section of the fastener assembly of FIG. 8 shown coupled.

DESCRIPTION OF THE PREFERRED EMBODIMENTS

Figure 1:
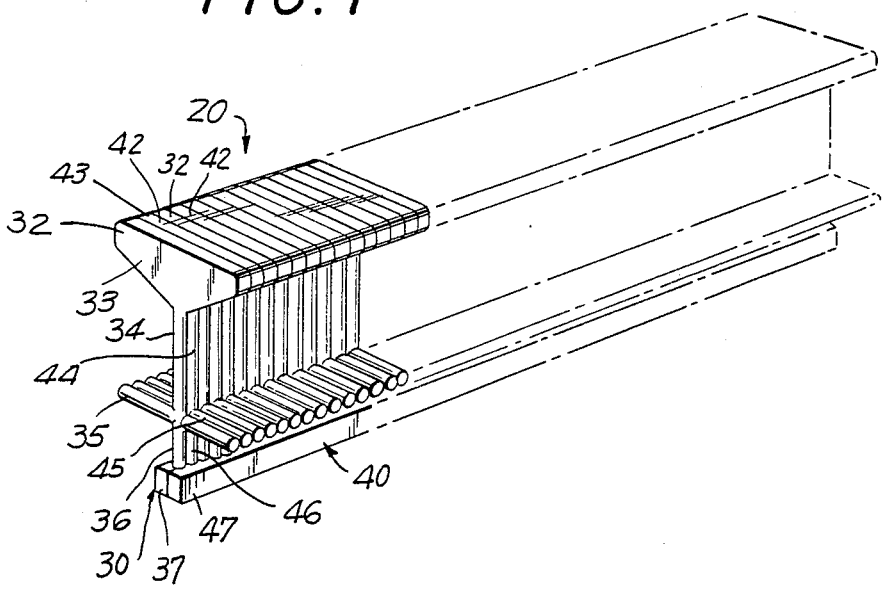
FIG. 1 is a perspective view of a tag pin fastener assembly constructed in accordance with a preferred embodiment of the present invention.

Reference is first made to FIGS. 1, 3 and 5 through 7 which depict a fastener assembly, generally indicated at 20, constructed in accordance with a first embodiment of the present invention. Tag pin fastener assembly 20 includes a first tag pin assembly member 30 and a second tag pin assembly member 40. First assembly member 30 includes a plurality of tag pins 32 and second assembly member 40 includes a plurality of tag pins 42. As will be described below in detail, tag pins 32 are alternately arranged with respect to tag pins 42.

Since first and second fastener assembly members 30 and 40 are of the same form, only the construction of first fastener assembly member 30 will be described in detail. Component parts of first fastener assembly member 30 will be numbered in the 30's and corresponding parts in second fastener assembly member 40 will be numbered in the 40's. First fastener assembly member 30 includes a plurality of tag pins 32 each of which include a plate-type head section 33 and a lateral rod or cross-bar 35 which are coupled together by a connecting string or filament 34. A connecting neck 36 extends from cross-bar 35 in a direction opposite to filament 34 such that tag pins 32 can be coupled through their respective connecting necks 36 to a connecting rod 37.

Figure 5:
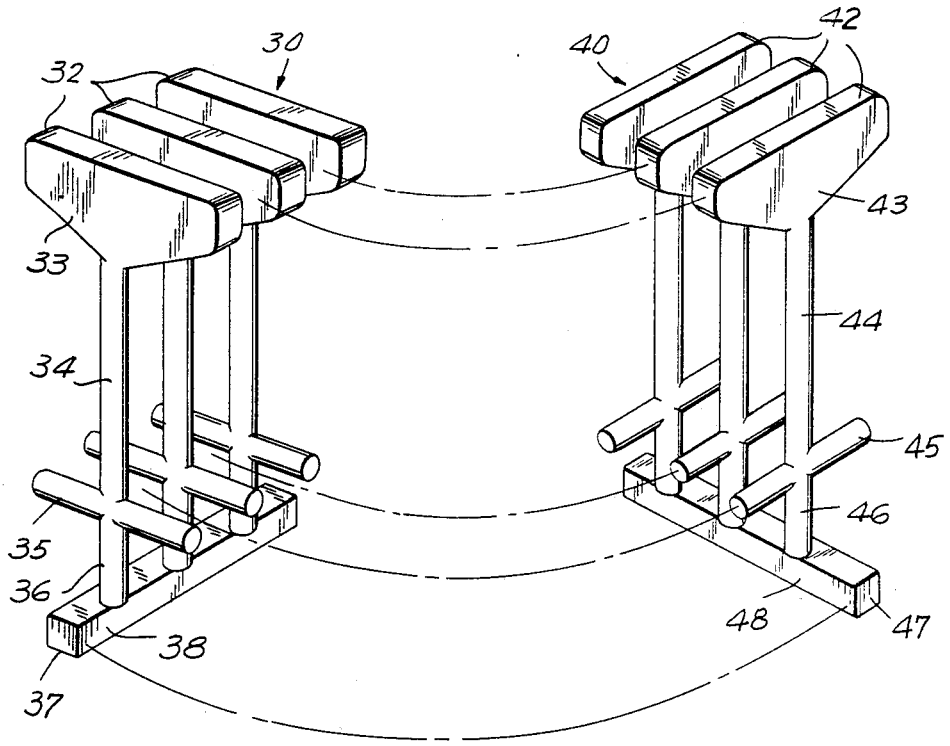
FIG. 5 is a perspective view of the two members of the fastener assembly depicted in FIG. 1 prior to being coupled together.

Connecting rod 37 includes a bonding surface 38 as best depicted in FIGS. 5 through 7, which is at the lower side of connecting neck 36 in the longitudinal direction. Bonding surface 38 is formed in such a way that it makes substantially a right angle with surface 39 of the lower end of connecting neck 36. Connecting neck 36 and connecting rod 37 are coupled at a connecting region 31 which is about half of the diameter of connecting neck 36. In other words, connecting neck 36 is formed partially on connecting rod 37 such that about half of connecting neck 36 indicated at 31, is formed on connecting rod 37 and the other half of connecting neck 36, indicated at 39, extends off of connecting rod 37 so as to substantially form a right angle with bonding surface 38. Outer surface 31*a* of connecting rod 37 at the side thereof which is opposite to bonding surface 38 protrudes out from the connecting region 31 of neck 36. Surface 31*a* can be made rectangular, circular, or the like.

In a preferred embodiment, in the fasteners 32 of first assembly 30 and fasteners 42 of second assembly 40, the thickness of the corresponding head sections 33, 43 and the diameter of the corresponding filaments 34, 44, cross bars 35, 45 and connection necks 36, 46 are between about 0.8 and 1.0 mm, and the distance between the fasteners on connecting rods 37 and 47 is between about 0.8 and 1.0 mm so that the fasteners of the two assemblies can be alternately inserted and positioned between corresponding fasteners on the other assembly. Such numerical examples are not necessarily required and the thicknesses, distances and diameters can be altered so long as the fasteners of one assembly member fit between and can be inserted between the fasteners of the other assembly member.

Tag pins 32 are formed on connecting rod 37 such that there is a predetermined spacing between each of tag pins 32. Similarily, tag pins 42 are arranged on connecting rod 47 at substantially the same predetermined spacing. Accordingly, tag pins 32 will be alternately arranged with respect to tag pins 42 when they are brought together and their respective connecting rods 37 and 47 coupled together.

Figure 2:
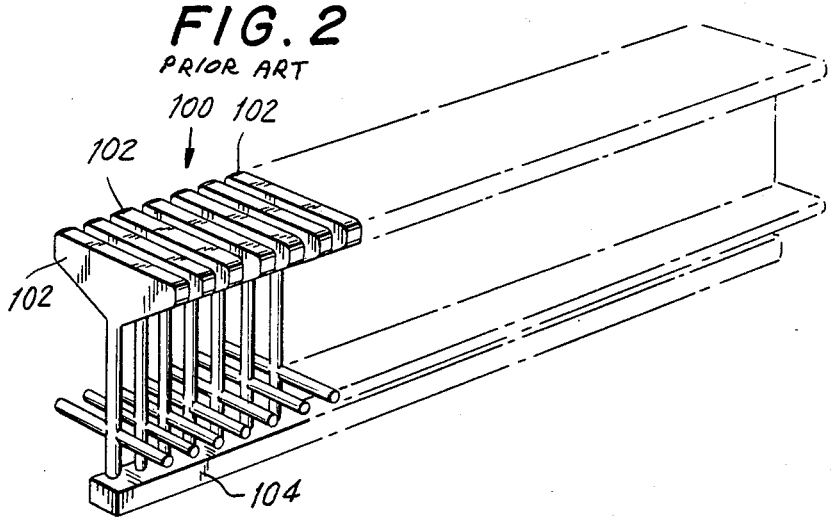
FIG. 2 PRIOR ART
FIG. 2 is a perspective view of a fastener assembly constructed in accordance with the prior art.
Figure 3:
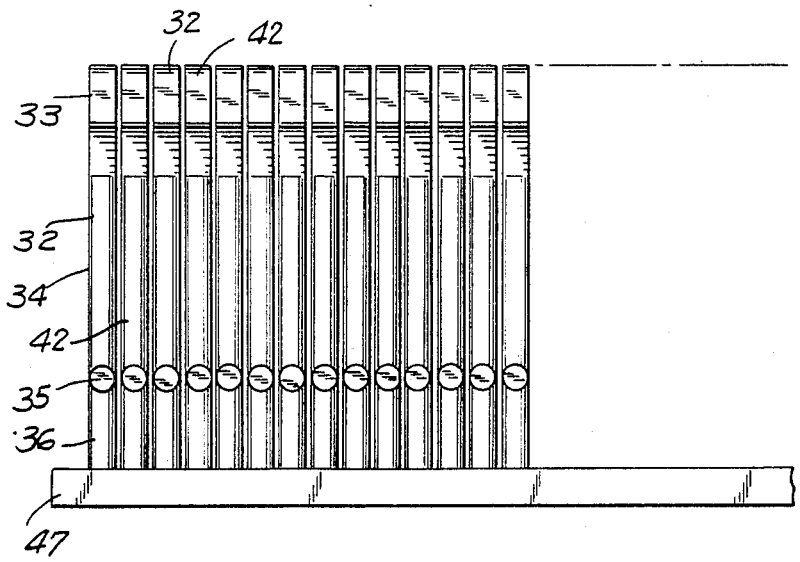
FIG. 3 is an enlarged side elevational view of the fastener assembly depicted in FIG. 1.
Figure 4:
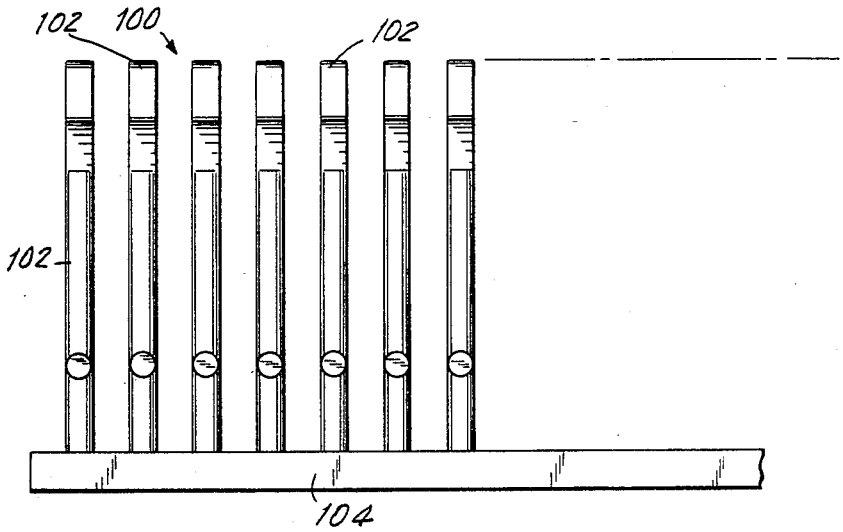
FIG. 4 PRIOR ART
FIG. 4 is an enlarged side elevational view of the fastener assembly of the prior art depicted in FIG. 2.

Prior art tag pin assemblies are depicted in FIGS. 2 and 4. Prior art tag pin assembly 100 includes a plurality of tag pins 102 which are integrally molded on a connecting rod 104. Due to mold limitations as described in detail above, spacing between adjacent tag pins 102 is limited by the thickness of the mold walls in the mold. Comparing FIG. 2 to FIG. 1 and FIG. 4 to FIG. 3, it is seen that the present invention permits a much more closely spaced tag pin assembly then was heretofore available in prior art constructions. Accordingly, the present invention obtains each of the objects and advantages detailed above.

The method of the present invention will now be described. Initially, the first and second tag pin assembly members are formed in a mold. The first and second tag pin assemblies each include a plurality of tag pins coupled to a separate connecting rod in predetermined spacing. Fasteners 32 of first fastener assembly member 30 are alternately inserted between fasteners 42 of second fastener assembly 40 such that they lie in a straight line. Corresponding head sections 33 and 43 and corresponding cross bars 35 and 45 of each fasteners lie in the same plane and connecting filaments 34 and 44 are positioned on the same vertical plane in the longitudinal direction. Fastener assembly members 30 and 40 are then coupled such as by bonding at the bonding surfaces 38 and 48 of the respective connecting rods 37 and 47. When the bonding surfaces 38 and 48 are bonded together, the lower end surfaces 39 and 49 of connection necks 36 and 46, respectively, of fasteners 30 and 40 are positioned over the upper surfaces of the other connecting rod of the other fastener assembly.

Bonding of the bonding surfaces of connecting rods 37 and 47 can be achieved by a plurality of methods such as by a high frequency bonding method, an ultrasonic bonding method, by use of bonding adhesives or by bonding by melt fusion or heat. It is noted that the first and second assembly members can be bonded together before filaments 34 and 44 are stretched, however, the assembly members may also be coupled after stretching of the respective filaments has been carried out.

In tag pin fastener assembly 20 constructed in accordance with the present invention, the thickness of the head section and the diameter of the filament and cross bar of each fastener are reduced somewhat while the distance between the fasteners is made narrower to between about 0.2 to 0.4 mm. As a consequence, a unit length of the assembly contains twice as many fasteners as in a conventional assembly. Accordingly, the package size can be reduced in half, thereby making it possible to load a fastener assembly with 100 tag pins into a tag pin attaching gun which in the prior art generally contained about 50 tag pins. Accordingly, the time for reloading the tag attaching gun can be substantially reduced.

Furthermore, when the present invention is utilized, weakening of the die wall and damage to the die can be prevented which occurred when it was attempted to reduce the thickness of the head and the diameter of the filament and cross bar of the fastener in a single mold as in the prior art. In particular, in the present invention, the distance between the fasteners can be equal to or even wider than the conventional spacing and, consequently, the mold for making the fastener assemblies can have a longer useful life.

FIGS. 8 and 9 depict a second embodiment of the present invention wherein connecting rod 57 includes a groove 62 and connecting rod 67 includes a corresponding tongue 72 adapted to fit into groove 62. Thus, when connecting rods 57 and 67 are coupled together, tongue 72 will lie in grooves 62 to provide a better and tighter bonding. The same bonding methods detailed above can be utilized. However, it is noted, that the tongue and groove arrangement can be such that a snap-fit occurs whereby the two member would be held together by a friction-snap fit.

In the second embodiment depicted in FIGS. 8 and 9, groove 62 and tongue 72 can be formed along the entire lengths of connecting rods 57 and 67, respectively. Alternatively, a plurality of openings or holes 62 may be provided along connecting rod 57 with corresponding projections on connecting rod 67 such that the projections fit or snap-fit into the corresponding openings in connecting rod 57. The tongue and groove can be formed in any shape so long as the tongue and groove can be engaged, depending only on the characteristics of the bonding machine and the machine for making the molds.

EXAMPLE 1

The thickness of head section 33 was made to be 0.9 mm with a diameter of the filament 34, cross-bar 35 and connecting neck 36 made to be 0.9 mm with a distance between fasteners made to be about 1.0 mm. Fastener assembly 30 was formed to contain 50 fasteners. Connecting rod 37 was formed such that bonding surface 38 was formed under neck 36 at the center line thereof with the connecting rod being coupled to the connecting neck 36 through connecting section 31. Fastener assembly 40 was formed in the same manner as fastener assembly 30.

Fastener assemblies 30 and 40 were positioned such that the corresponding bonding surfaces 38 and 48 of corresponding connecting rods 37 and 47 faced each other. Then, fasteners 42 of section member 40 were allowed to be alternatly inserted between fasteners 32 of first member 30. Bonding surfaces 38 and 48 of corresponding connecting rods 37 and 47 were bonded by a high frequency heating method while the bottom surfaces of the connecting rods 37 and 47 were positioned on the same plane. In this way, a fastener assembly containing 100 individual tag pins was obtained.

EXAMPLE 2

The method of example 1 was used but a concave groove 62 was formed along the whole length of connecting section at bonding surface 58 of the first assembly member. A protrusion or tongue 72 was formed along the whole length of connecting rod 67 on the second member. Thereafter, protrusion 72 was inserted in concave groove 62 and then bonding was completed.

In the fastener assembly which is provided according to the present invention, the fastener assemblies which are to be mutually combined are put together such that each of the fasteners in one assembly are alternately inserted between the fasteners of the other assembly. The connecting rods are then coupled together. Therefore, the thickness of a fastener and a fastener assembly has to be at most equal to or slightly smaller than the distance between two ajacent fasteners. For example, when the thickness of a fastener is between 0.8 mm and 0.9 mm, the distance between the adjacent fasteners should be between 0.9 mm and 1 mm.

In the present invention, at the time of forming the fasteners, the connecting rods of the assemblies to be bonded are formed only at one side of the lower section at the center where coupling to the connection necks is made such that the bonding surface is below the neck. Consequently, when the two assemblies are coupled together, the bonding surface formed on the connecting rod of each assembly is bonded to the corresponding bonding surface of the other assembly. In this fashion, the fasteners of each assembly are inserted between the fasteners of the adjacent assembly and are kept in a straight line.

It will thus be seen that the objects set forth above, among those made apparent from the preceding description, are efficiently attained and, since certain changes may be made in carrying out the above method and in the article set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A tag pin fastener assembly comprising a first tag pin assembly member having a first connecting rod and a plurality of tag pins coupled to said first connecting rod in a predetermined spacing, a second tag pin assembly member having a second connecting rod and a plurality of tag pins coupled to said second connecting rod in a predetermined spacing, and coupling means for coupling said first connecting rod directly to said second connecting rod so that said tag pins on said first rod are alternately arranged with the tag pins on said second rod to form a complete tag pin fastener assembly.

2. The tag pin fastener assembly as claimed in claim 1, wherein each said tag pin includes a head section and a cross bar coupled together by a filament, and a connecting neck extending from said cross bar in a direction opposite to said filament.

3. The tag pin fastener assembly as claimed in claim 2, wherein said connecting necks couple said tag pins to said respective first and second connecting rods.

4. The tag pin fastener assembly as claimed in claim 3, wherein said connecting necks are formed partially on said respective first and second connecting rods so that a portion of said connecting necks extend off of said respective first and second connecting rods.

5. The tag pin fastener assembly as claimed in claim 4, wherein said tag pins on said first and second connecting rod form a substantially straight line when said first and second connecting rods are coupled together.

6. The tag pin fastener assembly as claimed in claim 4, wherein about one-half of said connecting necks of said tag pins are coupled to said respective first and second connecting rods, the remaining portion of said connecting necks extending off of said respective first and second connecting rods.

7. The tag pin fastener assembly as claimed in claim 1, wherein the thickness of each said tag pin is substantially equal to said predetermined spacing of said respective tag pins.

8. The tag pin fastener assembly as claimed in claim 1, wherein the thickness of each said tag pin is slightly smaller than said predetermined spacing of said respective tag pins.

9. The tag pin fastener assembly as claimed in claim 1, wherein said predetermined distance is between about 0.8 and 1.0 mm.

10. The tag pin fastener assembly as claimed in claim 9, wherein the thickness of each said tag pin is between about 0.8 mm and 1.0 mm.

11. The tag pin fastener assembly as claimed in claim 1, wherein said first connecting rod includes a first bonding surface extending longitudinally therealong and said second connecting connecting rod includes a second bonding surface extending longitudinally therealong, said coupling means acting to couple said first and second bonding surfaces together.

12. The tag pin fastener assembly as claimed in claim 11, wherein said coupling means is selected from the group consisting of high frequency bonding, ultrasonic bonding, bonding adhesives, bonding by melt fusion and heat and snap-fit bonding.

13. The tag pin fastener assembly as claimed in claim 11, wherein said first bonding surface includes a groove and said second bonding surface includes a tongue, said tongue being inserted in said groove.

14. The tag pin fastener assembly as claimed in claim 13, wherein said groove extends along the length of said first bonding surface.

15. The tag pin fastener assembly as claimed in claim 14, wherein said tongue extends along said second bonding surface.

16. The tag pin fastener assembly as claimed in claim 11, wherein said first bonding surface includes a plurality of openings and said second bonding surface includes a plurality of corresponding projections, said projections being inserted in said corresponding openings.

17. The tag pin fastener assembly as claimed in claim 16, wherein said projections are snap-fit in said corresponding grooves.

18. A method of manufacturing a tag pin fastener assembly comprising the steps of molding a first tag pin assembly member having a first connecting rod and a plurality of tag pins coupled to said first connecting rod in a predetermined spacing, molding a second tag pin assembly member having a second connecting rod and a plurality of tag pins coupled to said second connecting rod in a predetermined spacing, and directly coupling said first connecting rod to said second connecting rod so that said tag pins on said first rod are alternately arranged with and extend in the same direction as the tag pins on said second rod.

19. The tag pin fastener assembly constructed according to the method of claim 18.

* * * * *